US006179408B1

(12) United States Patent
Rogers et al.

(10) Patent No.: US 6,179,408 B1
(45) **Date of Patent: *Jan. 30, 2001**

(54) APPARATUS FOR PRINTING WITH INK JET CHAMBERS UTILIZING A PLURALITY OF ORIFICES

(75) Inventors: Robert L. Rogers, Sandy Hook, CT (US); Arthur Mikalsen, Carmel, NY (US); Jeffrey G. Cartin, New Milford, CT (US)

(73) Assignee: Data Products Corporation, Simi Valley, CA (US)

( * ) Notice: Under 35 U.S.C. 154(b), the term of this patent shall be extended for 0 days.

This patent is subject to a terminal disclaimer.

(21) Appl. No.: 09/287,497

(22) Filed: Apr. 6, 1999

Related U.S. Application Data

(63) Continuation of application No. 09/020,756, filed on Feb. 9, 1998, now Pat. No. 5,966,148, which is a continuation of application No. 08/530,946, filed on Sep. 20, 1995, now Pat. No. 5,767,873, which is a continuation-in-part of application No. 08/310,967, filed on Sep. 23, 1994, now abandoned.

(51) Int. Cl.[7] ..... B41J 2/145; B41J 2/15; B41J 2/045

(52) U.S. Cl. ..... 347/40; 68/70

(58) Field of Search ..... 347/40, 47, 68, 347/70, 43, 48, 71

(56) References Cited

U.S. PATENT DOCUMENTS

| | | | |
|---|---|---|---|
| 4,032,929 | 6/1977 | Fischbeck et al. | 347/42 |
| 4,194,210 | 3/1980 | Krause | 347/77 |
| 4,357,614 | 11/1982 | Tamai | 347/47 |
| 4,379,304 | 4/1983 | Heinzl et al. | 347/47 |
| 4,396,924 | 8/1983 | Rosenstock | 347/68 |
| 4,439,780 | 3/1984 | DeYoung et al. | 347/68 |
| 4,459,601 | 7/1984 | Howkins | 347/68 |
| 4,646,106 | 2/1987 | Howkins | 347/9 |
| 4,680,595 | 7/1987 | Cruz-Uribe et al. | 347/68 |
| 4,714,934 | 12/1987 | Rogers | 347/40 |
| 4,901,093 | 2/1990 | Ruggiero et al. | 347/70 |
| 5,142,296 | 8/1992 | Lopez et all. | 347/12 |
| 5,767,873 | 6/1998 | Rogers et al. | 347/40 |

FOREIGN PATENT DOCUMENTS

| | | |
|---|---|---|
| 0 443 628 | 8/1991 | (EP) . |
| 56-93567 | 7/1981 | (JP) . |
| 56-135078 | 10/1981 | (JP) . |
| 57-188372 | 11/1982 | (JP) . |
| 60-92865 | 5/1985 | (JP) . |

OTHER PUBLICATIONS

"Ink Jet Head", IBM Technical Disclosure Bulletin, New York, Mar. 1974, vol. 16(10).

*Primary Examiner*—Thinh Nguyen
(74) *Attorney, Agent, or Firm*—Woodcock Washburn Kurtz Mackiewicz & Norris LLP

(57) ABSTRACT

A dense array of ink jets is achieved by a fanning-in of chambers to a linear array of orifices. The ends of the chambers remote from the orifices have actuation locations which are coupled to elongated transducers having axes of elongation which are parallel to the axes of ejection of droplets from the orifices.

26 Claims, 6 Drawing Sheets

APPARATUS FOR PRINTING WITH INK JET CHAMBERS UTILIZING A PLURALITY OF ORIFICES

CROSS-REFERENCES TO RELATED APPLICATION

This application is a continuation U.S. patent application Ser. No. 09/020,756, filed Feb. 9, 1998, now U.S. Pat. No. 5,966,148, which is continuation of U.S. patent application Ser. No. 08/530,946, filed Sep. 20, 1995, now U.S. Pat. No. 5,767,873, which is a continuation-in-part of U.S. application Ser. No. 08/310,967, filed Sep. 23, 1994, now abandoned.

BACKGROUND OF THE INVENTION

This invention relates to impulse or drop-on demand ink jet printers employing an array of ink jets which are capable of printing a substantial field of droplets on demand.

U.S. Pat. No. 4,714,934 discloses an ink jet apparatus of the type shown in FIGS. 1 through 3. The apparatus includes a print head 10 having a reservoir 12 and an imaging head of 14. The print head 10 is juxtaposed to a target 16 which is advanced by means of a transport system, including rollers 18 and 20, in an incremental fashion. As shown in FIG. 1, print head 10 includes an orifice plate 22, including orifices 24. In FIG. 1, the orifices are shown further apart from each other than they are in practice for purposes of illustration.

The orifices 24 actually comprise a plurality of sets of orifices which are more fully described with reference to FIGS. 2 and 3. The sets of orifices 24 are vertically displaced as a result of the inclination of the print head 10 with respect to the scanning direction depicted by arrow 26. The orifices 24 are arranged in groups of three (3) and inclined on the orifice plate 22 so as to be substantially vertical when the print head 10 is inclined with respect to the scanning direction 26 as shown in FIG. 1. The hash marks 28 and the orifice plate actually show this angle of inclination. The angle of the orifices 24 in each group with respect to the vertical as shown in FIG. 2 is chosen such that when the orifice plate 22 is inclined as shown in FIG. 1, sets of orifices 24 will be vertical. As scanning in the direction depicted by the arrow 26 proceeds, there is no overlap of any droplets projected from the orifices so as to permit the apparatus as shown in FIGS. 1 through 3 to create a vertical bar when the droplets are ejected sequentially in the proper timed relationship. Of course, the droplets can also produce an alphanumeric character by ejecting appropriate droplets on demand.

By changing the angle of inclination of the hash marks 28, it is possible to change the angle of inclination of the print head 14. However, if the angle of inclination is increased beyond a certain limit, it becomes impossible to print a continuous bar since the orifices cannot be spaced sufficiently close together to provide full coverage of the field. In addition, the chambers associated with those orifices become starved for ink when operated at a sufficiently high frequency. Moreover, it has not been possible to increase the number of chambers since cross-talk and limited real estate do not allow transducers to be coupled to the chambers.

As also shown in U.S. Pat. No. 4,714,934, the individual ink jets include feet which are coupled to the ink jet chambers. These feet 46 are secured to a foot plate by a resilient rubber-like material, such as silicone. As a consequence, ink within the ink jet chambers is exposed to a variety of materials including the foot, the silicone and the materials from which the remainder of the ink jet including the chamber and the orifices are made. This in turn produces compatibility problems which effectively limit the type of ink which may be employed in an ink jet apparatus.

SUMMARY OF THE INVENTION

In accordance with one important aspect of the invention, an ink jet apparatus is provided whereby the spacing between a plurality of impulse ink jets in an array is substantially reduced thereby increasing the ability to print high quality images with an in-line array of orifices while minimizing cross-talk.

In accordance with this object of the invention, an ink jet apparatus comprises an array of chambers, each of the chambers being terminated in at least one orifice such that the linear array of orifices is formed. Each of the chambers includes an actuation location laterally displaced from the linear orifice array. A plurality of elongated transducers is juxtaposed to the actuation locations respectively such that the transducers have an axis of elongation extending substantially parallel with the ejection axis of each orifice and laterally displaced with respect to the linear orifice array.

In accordance with one important aspect of the invention, the actuation locations of adjacent chambers in the array of ink jet devices are mutually laterally displaced.

In accordance with another important aspect of the invention, the axis of chambers are inclined at an acute angle with respect to the ejection axis of the chambers.

In accordance with another important aspect of the invention, the axes of the chambers are elbowed to include a first segment substantially parallel to the ejection axis and a second segment substantially perpendicular to the ejection axis.

In accordance with still another important aspect of the invention, the axes of elongation of adjacent transducers are parallel but laterally displaced with respect to the axis of ejection from each of the orifices.

In accordance with yet another important aspect of the invention, each of the chambers may include one or more orifices.

It is another object of this invention to provide an impulse ink jet apparatus which has a high degree of compatibility with various inks. In accordance with this object of the invention, the ink jet apparatus includes an ink jet chamber, a transducer coupled to the chamber and a diaphragm separating the transducer from the chamber. In the preferred embodiment of the invention, the chamber and the diaphragm comprise a relatively inert material such as, for example, stainless steel.

The transducer is bonded to the diaphragm by a suitable adhesive such as for example, a silicone adhesive. The transducer may also be encapsulated in a silicone material for acoustic damping.

Preferably, the chamber is formed by sandwiching a plurality of stainless steel plates together including the diaphragm. The plates may comprise an orifice plate, chamber plate, a restrictor plate providing a restricted opening for ink to enter the chamber, the diaphragm and a spacer plate separating the diaphragm from the restrictor plate such that movement of the diaphragm does not affect the size of the restricted opening to the ink jet chamber.

DETAILED DESCRIPTION OF THE DRAWINGS

DETAILED DESCRIPTION OF PREFERRED EMBODIMENTS

Figure 4:
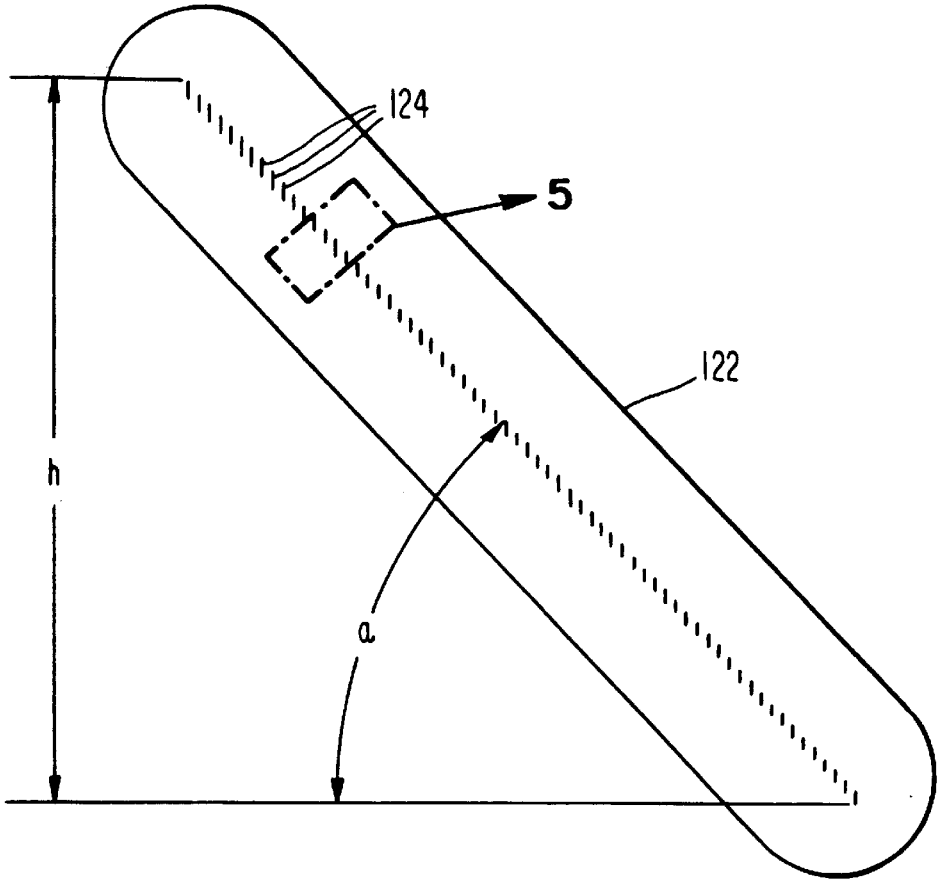
FIG. 4 is a plan view of the orifice plate of an ink jet apparatus embodying this invention.
Figure 5:
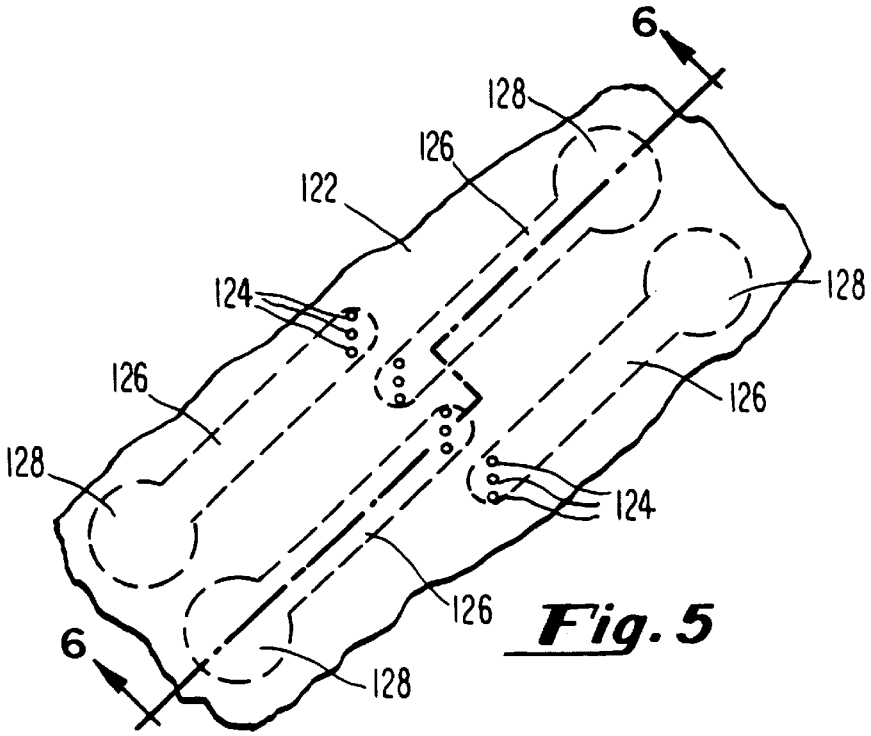
FIG. 5 is an enlarged view of the fragment 5 shown in FIG. 4.
Figure 6:
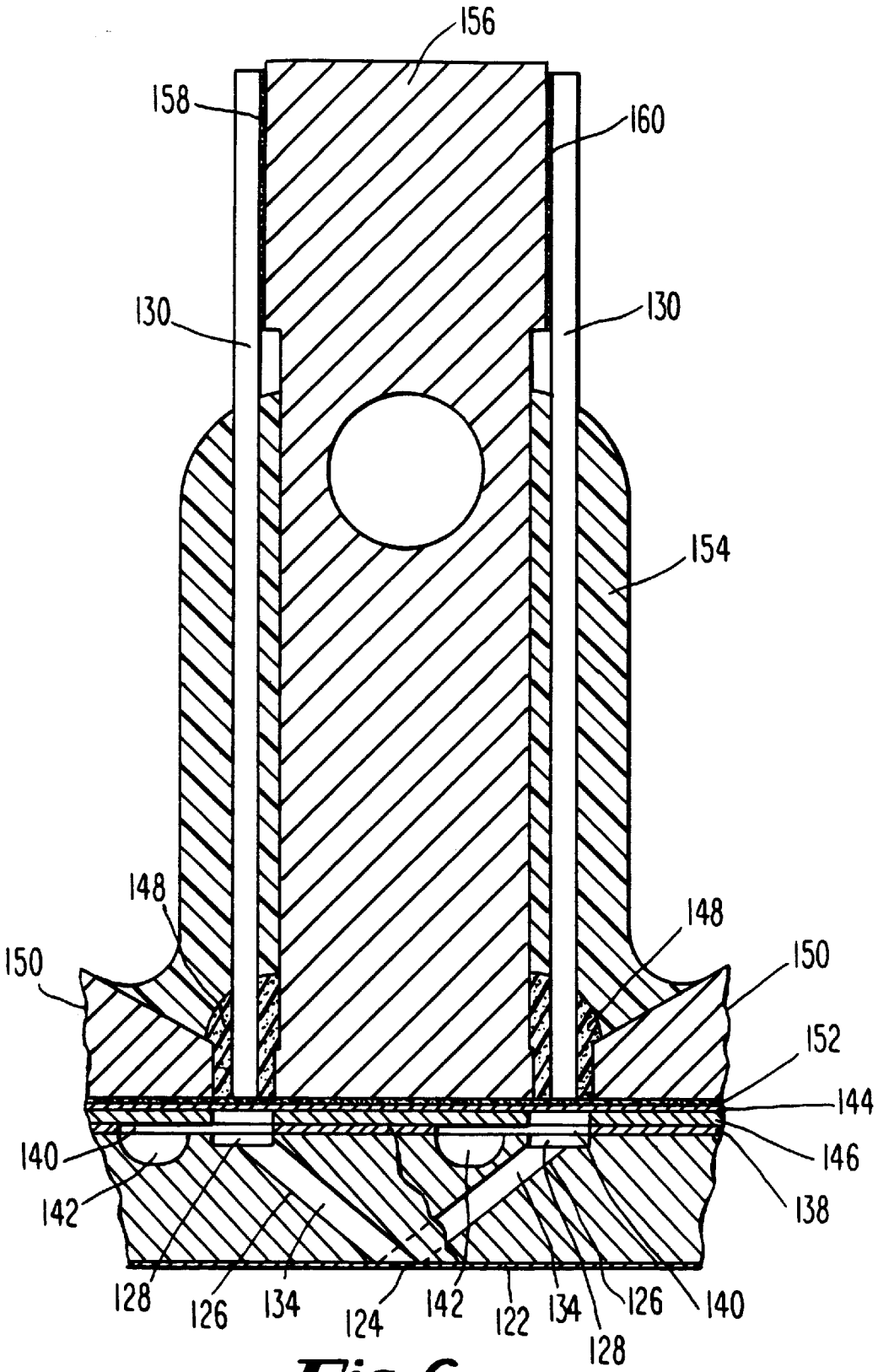
FIG. 6 is a sectional view of the ink jet apparatus of FIG. 4 taken along line 6—6 of FIG. 5.

Referring to FIGS. 4–6, one preferred embodiment of the invention comprises an orifice plate 122 having groups of three orifices 124 forming a linear array. In all, a total of 64 groups of orifices 124 are shown. Each linear array of orifices 124 is inclined such that the orifices 124 are vertically disposed with respect to the scanning direction when incorporated in a print head similar to that shown in FIG. 1. The angle of inclination of the orifice plate and thus the linear array of orifices 124 is 47.105 degrees so as to provide an overall field height h of 1.36 inches. As should be appreciated, the spacing between the groups of orifices 124 is necessarily small.

Figure 7A:
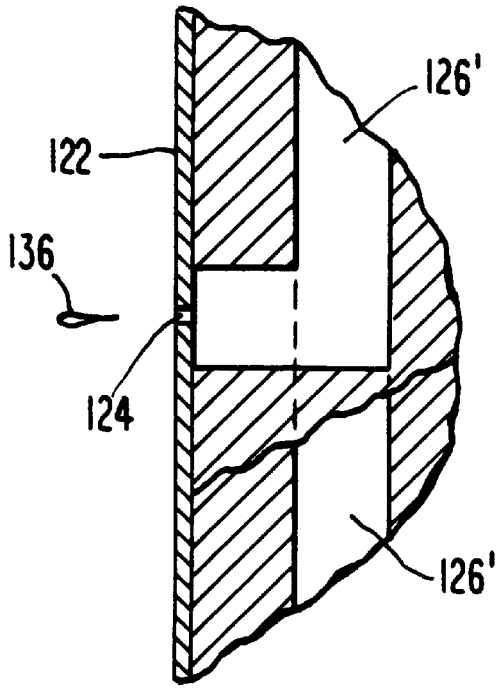
FIG. 7A is a view similar to FIG. 7 but of the second embodiment depicted in FIG. 6A.
Figure 7:
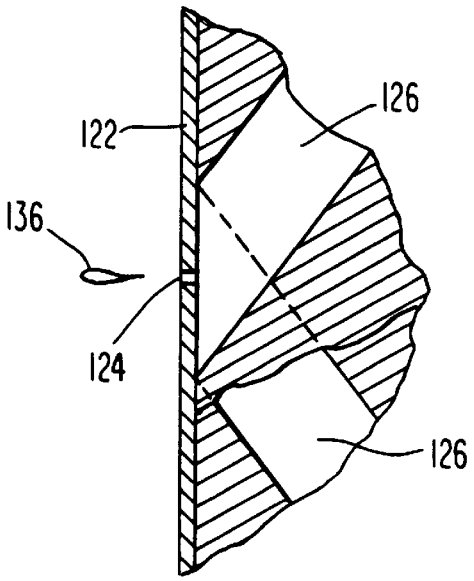
FIG. 7 is an enlarged fragmentary view of a fragment of FIG. 6.

As shown in FIGS. 5–7, the orifices 124 terminate ink jet chambers 126 in drop-on-demand or impulse devices of the general type disclosed in U.S. Pat. No. 4,646,106, incorporated herein by reference. Because the chambers 126 are necessarily closely spaced, it is not possible to confine the chambers to the area between adjacent groups of orifices 124. Rather, it is necessary to laterally extend the chambers 126 in opposite directions so as to provide actuation locations 128 which are laterally displaced from the linear array. As best shown in FIG. 5, the actuation locations 128 of adjacent chambers 126 are mutually laterally displaced. By virtue of this lateral displacement, there is sufficient room for elongated transducers 130, shown in FIG. 6, to eject droplets of ink on demand from the orifices 124 without cross-talk between chambers.

As best shown in FIGS. 6, 6A, 7 and 7A, the chambers 126 or 126' may include either elongated sections 134 which are disposed at an acute angle with respect to the axis of ejection of droplets from orifice 124 as well as the axis of elongation of the transducers 130 or a elongated sections 134' which project along the axis of elongation of the transducers, then bend 90° towards the centerline or axis of ejection of droplets from orifice 124 and then bend 90° again traversing along the axis of ejection of droplets from orifice 124.

The inclined or elbowed, elongated portions 134 (or 134') of the chambers 126 (or 126') create a fanning-in effect so as to permit alignment of the groups of orifices 124 in a linear array while providing separation of the elongated transducers 130. Note that only a single orifice is shown in FIGS. 7 and 7A since the sections represented by FIGS. 6, 6A, 7 and 7A is through a single orifice. However, it will be appreciated that there are up to three orifices associated with each of the chambers 126 or 126' shown in FIGS. 6, 6A, 7 and 7A. By utilizing this fanning-in effect, it is possible to achieve greater chamber density. For example, it is possible to achieve a chamber-to-chamber spacing of less than 0.0500 inches, preferably less than 0.0400 inches, and optimally less than 0.0300 inches without cross-talk. The fan-in effect also allows chamber-to-chamber spacing of less than ten times the diameter or cross-sectional dimension of the chamber and preferably less than seven times this diameter.

Figure 6A:
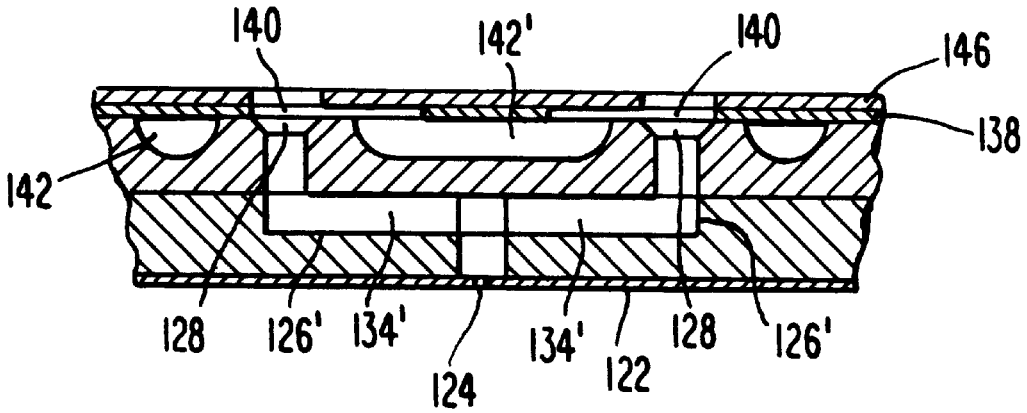
FIG. 6A is a partial view similar to FIG. 6 but depicting a second embodiment of the invention (in this embodiment, the elongated portions of chambers 126 are implemented with right angles)

As also shown in FIGS. 6 and 6A, the ink jet apparatus includes a restrictor plate 138 having openings 140 which connect the actuation locations 128 with manifolds 142. The manifolds 142 service an aligned row of actuation locations 128 with ink while an other manifold 142 services another aligned row of actuation locations 128 with ink. Additional manifolds 142 external to the elbowed elongated portions 134' of the chambers in FIG. 6A create additional fluidic compliance and permit secondary servicing of center manifold 142' and downstream activation locations 128.

In accordance with another important aspect of the invention, the ink which is ejected from the orifices 124 is separated from the transducer and its mounting materials by a relatively inert diaphragm 144 (see FIG. 6). Preferably, the diaphragm comprises stainless steel. Diaphragm 144 moves with the transducers 130 so as to eliminate ink compatibility problems. In order to assure that deflection of the diaphragm 144 by the transducers 130 does not affect the size of the restrictor opening 140, a spacer plate 146 is inserted between the diaphragm 144 and the restrictor plate 138.

In accordance with an important aspect of the invention, the diaphragm 144 (FIG. 6) is secured to the transducers 130 by an elastomeric adhesive (e.g., silicone) which extends upwardly into openings 148 in a body 150 and forms a layer 152 along the top of the diaphragm 144. As a consequence, retraction of the transducer 130 pulls the diaphragm 144 upwardly at the actuation locations 128 so as to permit additional ink from the manifolds 142 to enter the chambers 126. When the transducers 130 are deenergized (i.e., electrically grounded), the diaphragm 144 will return to the quiescent, planar condition and droplets of ink 136 will be ejected from the orifices 124 as shown in FIGS. 7 and 7A. In addition to the silicone adhesive, the transducer is secured to the body 150 and a central mounting 156 by an LRTV silicone 154. A conductive epoxy 158 (e.g., a silver epoxy) joins the transducers 130 to the mounting 156 at the extremity remote from the diaphragm 144.

Figure 9:
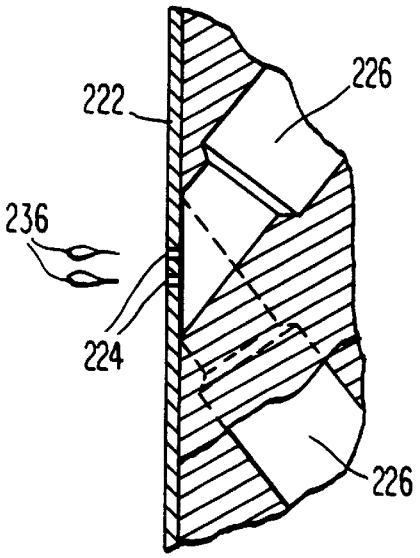
FIG. 9 is a fragmentary sectional view of the apparatus of FIG. 8 taken along line 9—9.
Figure 8:
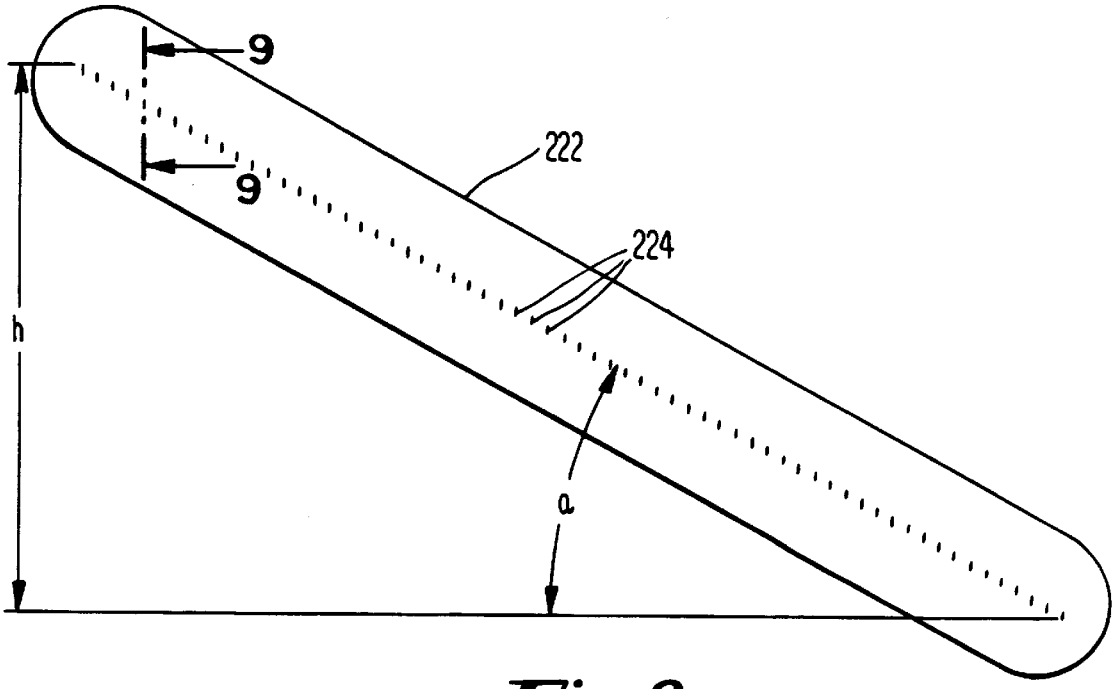
FIG. 8 is a plan view of an orifice plate representing another embodiment of the invention.

Referring now to FIGS. 8 and 9, another embodiment of the invention is shown wherein the angle of inclination $\alpha$ of an orifice plate 222 is reduced to 29.236 degrees so as to provide an overall field height of 0.92 inches. The orifices 224 are arranged in groups of two. Thus the density of chambers from end to end of the orifice plate, 64 chambers in all, remains the same although the number of orifices is reduced since there are only two orifices 224 per chamber. As in the case of the embodiment of FIGS. 4, 5, 6 and 7, the elongated portions of the chambers 226 are inclined so as to provide lateral displacement of the actuation locations of the chambers, which are not shown in FIGS. 8 and 9. However, it will be appreciated that the chambers look substantially as shown in FIGS. 6 and 7 such that the elongated portions of chambers 226 are inclined with respect to the axis of ejection for the droplets 236 as well as the axis of elongation for the elongated transducers.

Figure 11A:
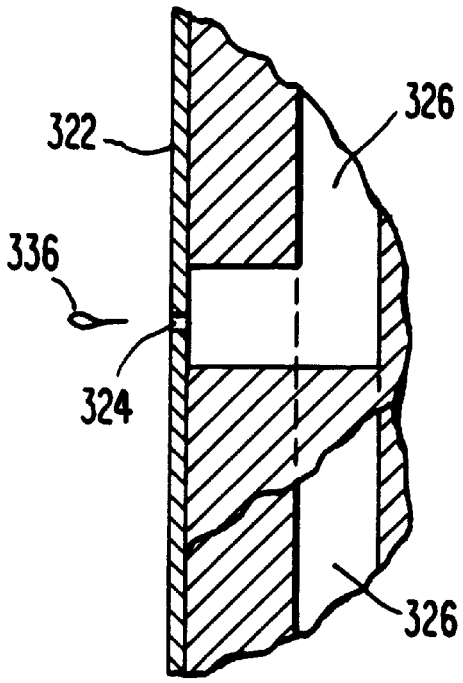
FIG. 11A is a view similar to FIG. 11 but of yet another embodiment similar to that of FIGS. 6A and 7A.
Figure 11:
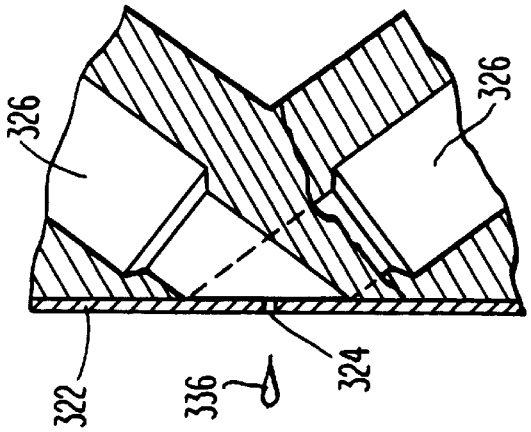
FIG. 11 is an enlarged fragmentary sectional view of the ink jet apparatus of FIG. 10.
Figure 10:
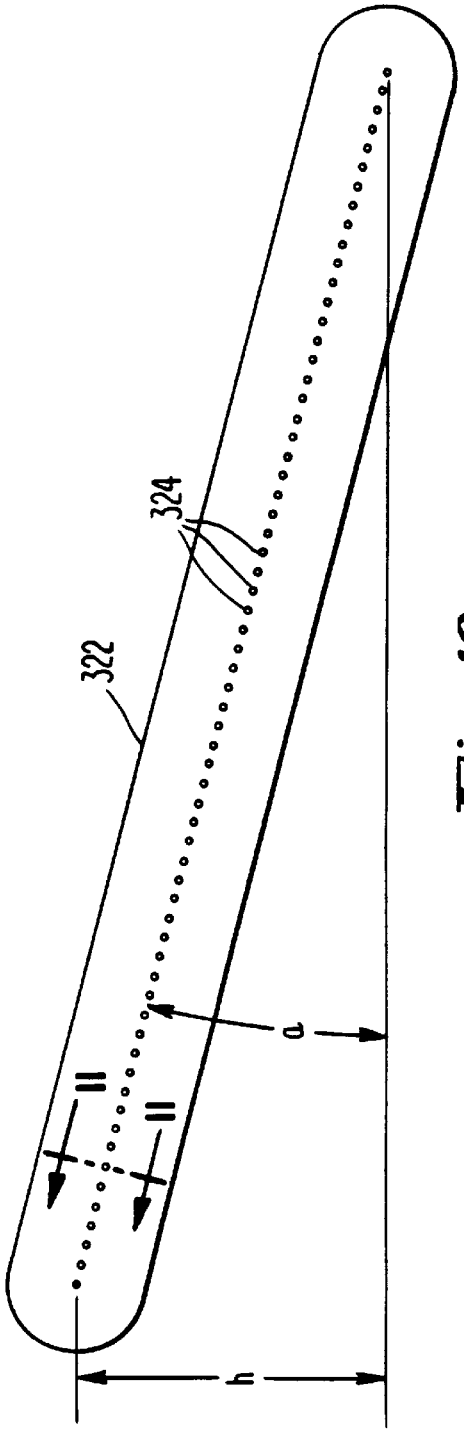
FIG. 10 is a plan view of the orifice plate of another ink jet apparatus representing yet another embodiment of the invention.

Referring now to FIGS. 10, 11 and 11A, an orifice plate 322 is shown having a total of 64 channels terminating in orifices 324. The orifices and channels or chambers are arrayed in linear fashion at an angle a of 14.135 degrees with respect to the scanning axis so as to provide an overall field dimension h equal to 0.46 inches. As shown in FIG. 11, the chambers 326 are once again inclined with respect to the axis of ejection of droplets 336. As shown in FIG. 6, the elongated transducers are also inclined with respect to the chambers 326. It will therefore be appreciated that, with reference to FIGS. 10 and 11, there are a total of 64 channels shown with 64 orifices, i.e., one orifice per chamber. This also applies to embodiments of FIGS. 6A and 11A in that there are a total of 64 channels shown with 64 orifices, i.e., one orifice per chamber.

Figure 12:
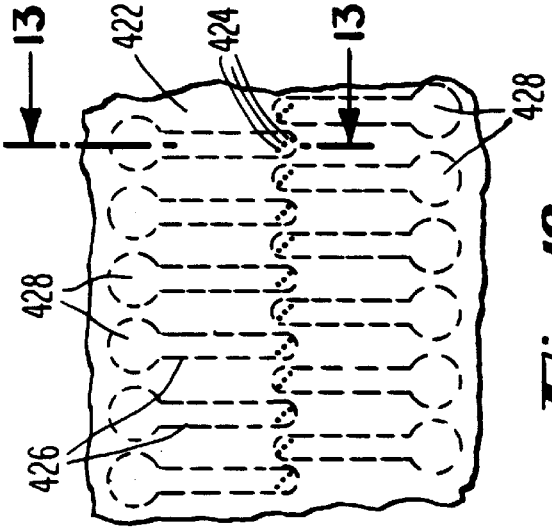
FIG. 12 is a plan view of another ink jet apparatus orifice plate representing another embodiment of the invention.
Figure 13:
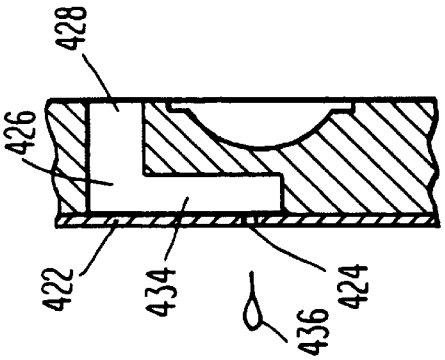
FIG. 13 is a sectional view of the ink jet apparatus of FIG. 12 taken along line 13—13.

Reference will now be made to FIGS. 12 and 13 and the ink jet apparatus shown therein. FIG. 12 depicts an orifice plate 422 having groups of orifices 424, i.e., 3 orifices per channel or group. The chambers 426 extend laterally outwardly from the linear array of orifices 424 such that actuation locations 428 are laterally displaced from the linear array. As shown in FIG. 13, the chambers 428 are not inclined with respect to the axis of ejection of droplets 436 but are formed with a right angle configuration. A first portion 434 extends laterally outwardly from the orifice to the actuation location 428. A single manifold 150 is shown which through the use of a restrictor plate, not shown serves all chambers extending laterally outwardly from the linear array.

Figure 1:
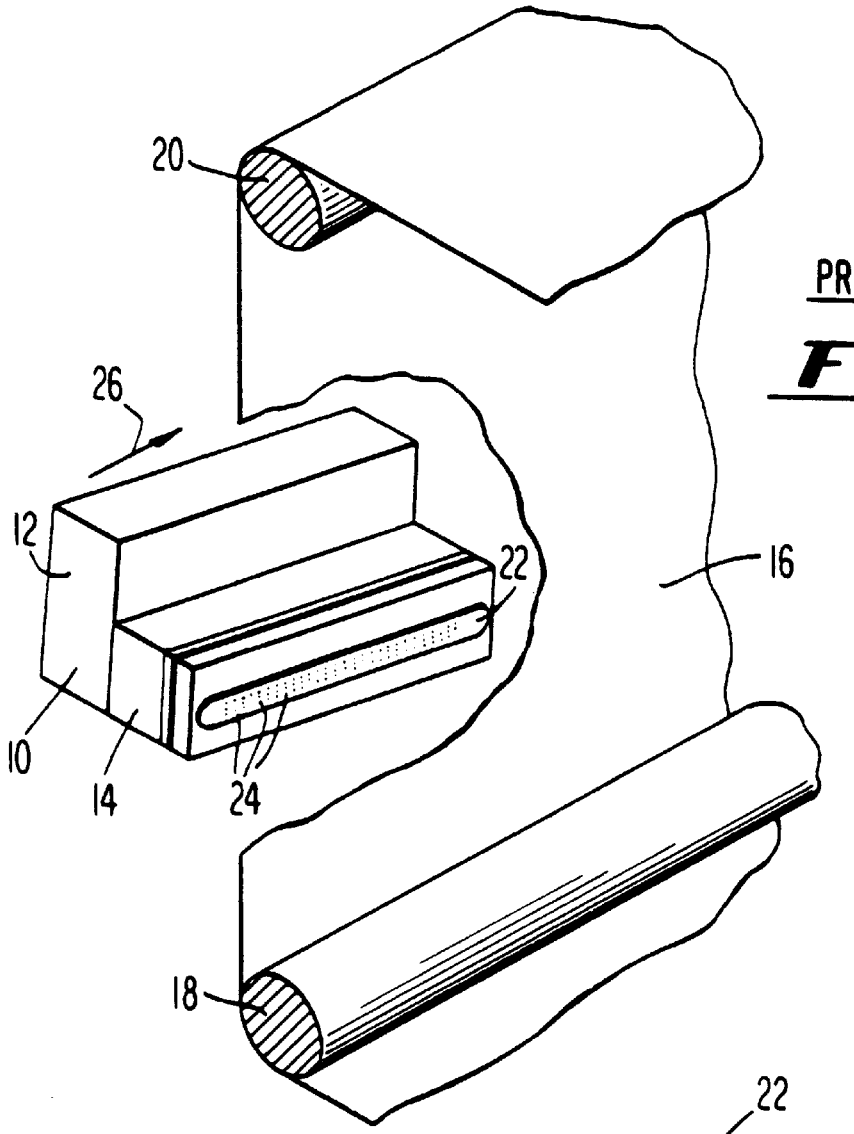
PRIOR ART Fig. 1
FIG. 1 is a perspective view of the prior art ink jet printing apparatus previously discussed.
Figure 2:
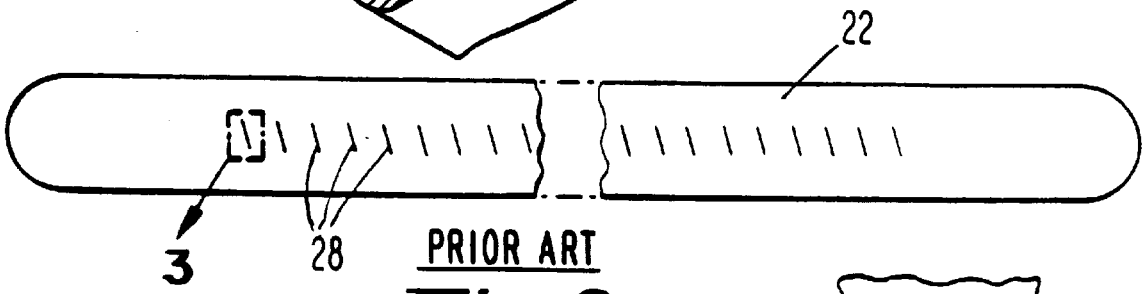
PRIOR ART Fig. 2
FIG. 2 is a plan view of an orifice plate of the prior art apparatus shown in FIG. 1.
Figure 3:
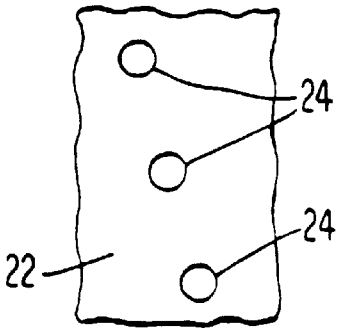
PRIOR ART Fig. 3
FIG. 3 is a fragmentary view of the fragment 3 of the prior art apparatus shown in FIG. 2.

With the various embodiments described, it will be appreciated that the center-to-center spacing between the chambers may be substantially reduced, thereby providing increased resolution. Heretofore, prior art of the types shown in FIGS. 1–3 provide a center distance between chambers of approximately 0.0585 inches. Employing the principles of this invention, it is possible to reduce that center-to-center spacing of 64 chambers shown in FIG. 4 to 0.02952 inches.

In accordance with an important aspect of the invention, in particular the use of a stainless steel diaphragm, it is possible to provide for an ink jet device wherein substantially all materials exposed to the ink are relatively inert. In this regard, it is possible to provide a restrictor plate 138 and diaphragm 144 and a spacer plate 146 which are all stainless steel. It is also possible and preferred to provide a chamber plate in which the chambers 126 and the manifolds 142 are formed which comprises stainless steel or another relatively inert material. Other relatively inert materials include Kapton, PET or Teflon.

It will be appreciated that various configurations of chambers, orifices and chamber shapes may be utilized. For example, the number of chambers may exceed 64. For example, an array of 128 or 256 chambers or more may be utilized. It is also possible to terminate chambers in more than three orifices. For example, chambers terminating in four, five or six orifices or more are possible. Finally, it is possible to utilize various chamber shapes in addition to the inclined, elbowed or L-shaped chambers disclosed herein. It will further be appreciated that alignment of the array of orifices in linear fashion allows the use of various angles of inclination of the head thereby permitting a wide variety of applications of the ink jet apparatus.

Although preferred embodiments of the invention have been shown and described, it will be appreciated that various modifications may be made which will fall within the true spirit and scope of the invention as set forth in the appended claims.

We claim:

1. An impulse jet apparatus comprising:

a plurality of side-by-side orifices forming a linear array, wherein each of said orifices ejects droplets along an ejection axis and opens into at least one chamber, each of said chambers mutually laterally displaced from adjacent chambers, and each of said chambers having an actuation location laterally displaced from the linear array and offset along the linear array from the actuation locations of adjacent chambers.

2. The impulse jet apparatus of claim 1, wherein the chambers have axis that are inclined at an angle with respect to said ejection axis.

3. The impulse jet apparatus of claim 2, wherein said angle is acute.

4. The impulse jet apparatus of claim 2, wherein said angle is obtuse.

5. The impulse jet apparatus of claim 1, wherein the axis of the chambers are elbowed and include a first segment substantially parallel to the ejection axis and a second segment substantially perpendicular to the ejection axis.

6. The impulse jet apparatus of claim 1, wherein the axis of the chambers are elbowed and include a first segment substantially perpendicular to the ejection axis and a second segment substantially parallel to the ejection axis.

7. The impulse jet apparatus of claim 6, wherein said axis of the chambers further comprise a third segment perpendicular to the ink ejection axis.

8. The impulse jet apparatus of claim 1, wherein said plurality of side-by-side orifices forming a linear array comprises groups of orifices arranged side-by-side.

9. The impulse jet apparatus of claim 8, wherein for each of said groups of orifices, the orifices open into a single chamber.

10. The impulse jet apparatus of claim 8, wherein each of said groups of orifices comprises three orifices.

11. The impulse jet apparatus of claim 8, wherein each of said groups of orifices comprises two orifices.

12. The impulse jet apparatus of claim 8, wherein each of said groups of orifices comprises between 1 and 10 orifices.

13. The impulse jet apparatus of claim 8, having a chamber-to-chamber spacing between adjacent chambers less than 0.0500 inches.

14. The impulse inkjet apparatus of claim 13, wherein said chamber-to-chamber spacing is less than 0.0400 inches.

15. The impulse inkjet apparatus of claim 13, wherein said chamber-to-chamber spacing is less than 0.0300 inches.

16. The impulse jet apparatus of claim 1, wherein said chambers have a portion extending from the actuation locations respectively arranged in a fanning-in effect.

17. The impulse jet apparatus of claim 16, wherein said chamber-to-chamber spacing is less than 0.0300 inches and at least one of said chamber portions is inclined or elbowed.

18. The impulse jet apparatus of claim 1, further comprising a plurality of elongated transducers juxtaposed to said actuation locations respectively, and laterally displaced from said orifices respectively, said transducers having an axis of elongation extending substantially parallel with said ejection axis.

19. The impulse jet apparatus of claim 18, wherein the axis of elongation of adjacent transducers are offset with respect to the axis of ejection.

20. The impulse jet apparatus of claim 18, further comprising for each chamber, a diaphragm coupling the transducer to the chamber and separating the transducer from the volume of fluid within the chamber, said transducer being attached to said diaphragm such that the diaphragm is deformed so as to expand the chamber to an enlarged state when the transducer is energized and return the diaphragm to a planar state when the transducer is deenergized.

21. The impulse jet apparatus of claim 20, wherein said transducer has an axis of elongation that intersects the diaphragm.

22. The impulse jet apparatus of claim 20, further comprising adhesive means for attaching said transducer to said diaphragm.

23. The impulse jet apparatus of claim 22, further comprising a chamber plate for forming said chamber, a restrictor plate providing a restricted opening for fluid to enter the chamber, and a spacer plate separating the diaphragm from the restrictor plate such that movement of said diaphragm does not restrict fluid from entering the chamber through the restricted opening.

24. The impulse jet apparatus of claim 23, wherein said chamber plate, said restrictor plate, said diaphragm and said spacer plate comprise stainless steel.

25. The impulse jet apparatus of claim 22, wherein said adhesive comprises a elastomeric adhesive for attaching said transducer to said diaphragm.

26. The impulse jet apparatus of claim 20, further comprising for each chamber, a foot plate positioned between said diaphragm and said transducer.

* * * * *